United States Patent [19]

Terzian et al.

[11] 4,120,117

[45] Oct. 17, 1978

[54] ARTICULATED FIGURE TOY

[75] Inventors: Rouben T. Terzian, Chicago; Howard J. Morrison, Deerfield; Palmer J. Schoenfield, Evanston; Wayne A. Kuna, Elmhurst, all of Ill.

[73] Assignee: Marvin Glass & Associates, Chicago, Ill.

[21] Appl. No.: 762,407

[22] Filed: Jan. 26, 1977

[51] Int. Cl.[2] ..... A63H 13/12; A63H 13/16

[52] U.S. Cl. ..... 46/130; 46/145; 124/16

[58] Field of Search ..... 46/128, 129, 130, 134, 46/148

[56] References Cited

U.S. PATENT DOCUMENTS

| | | | |
|---|---|---|---|
| 1,362,248 | 12/1920 | Ford | 46/129 |
| 1,429,382 | 9/1922 | Vaughan | 46/130 |
| 1,937,162 | 11/1933 | Parrish | 46/134 |
| 2,535,868 | 12/1950 | Roberts | 46/129 |
| 2,656,646 | 10/1953 | Wideman | 46/134 |

FOREIGN PATENT DOCUMENTS

| | | | |
|---|---|---|---|
| 435,782 | 10/1926 | Fed. Rep. of Germany | 46/134 |

*Primary Examiner*—E. Barry Shay
*Attorney, Agent, or Firm*—Mason, Kolehmainen, Rathburn & Wyss

[57] ABSTRACT

A figure toy adapted to change its posture upon impact includes a central body or mid-torso portion having an upper torso or body portion and a lower torso or hip portion pivotally coupled thereto. The figure toy further includes a bistable, force-applying element that pivots the upper and lower torso portions relative to the central body portion upon impact to the figure toy. The figure toy further includes a pair of arms, pivoted to the upper torso portion and a pair of legs, pivoted to the hip portion, which are actuated by the force applying element. A launching device is provided including a biased figure toy mounting platform which is held in a prelaunching position by a latch. The latch is depressed by a selectively actuable element to release the platform and launch the figure toy. A second launching device is disclosed which includes a figure toy mounting platform pivotally coupled to a base. The platform includes a device for holding the doll onto the platform until the platform is pivoted through a predetermined angle by an actuating element, whereupon the figure toy is released.

10 Claims, 20 Drawing Figures

Fig 14
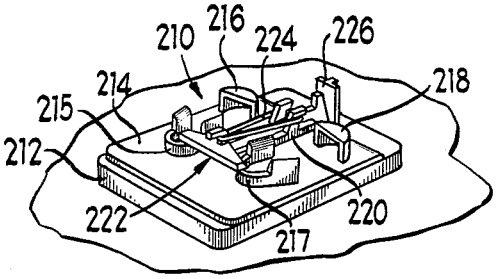
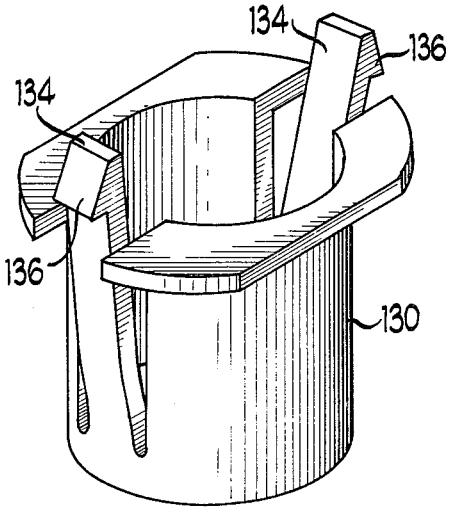
Fig 19
Fig 15
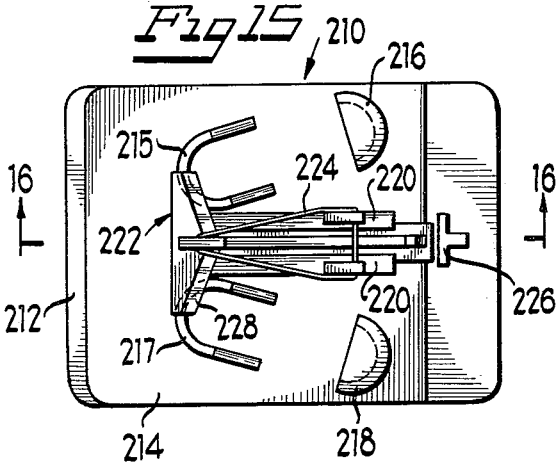
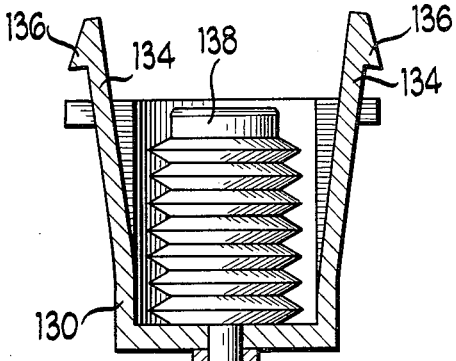
Fig 16
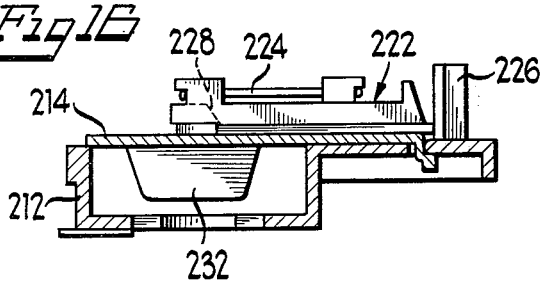
Fig 20
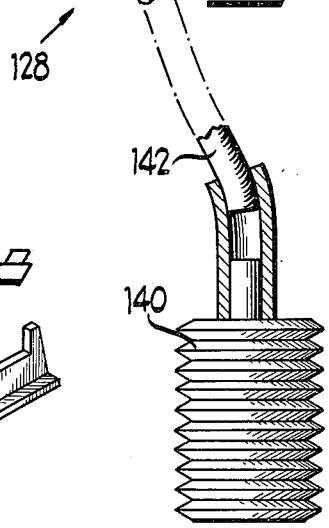
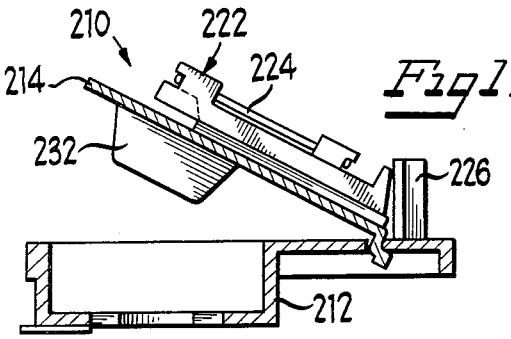
Fig 17
Fig 18
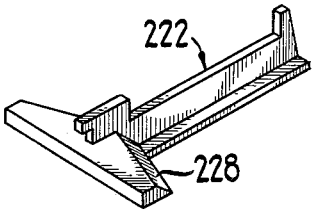

ARTICULATED FIGURE TOY

BACKGROUND OF THE INVENTION

1. Field of the Invention

The present invention relates to an articulated figure toy resembling a stunt person adapted to change posture upon impact with an object such as the railing of a building or the ground when dropped from an elevation. In addition, the present invention relates to devices for launching a figure toy into the air or against objects.

2. Description of the Prior Art

A typical articulated figure toy is primarily used to perform different functions such as tumbling or gymnastics with a bar or similar device. In addition, there are different structures for articulated dolls or figures that allow the figure to be placed in various positions, such as in a standing or a sitting posture. Such a figure is illustrated in U.S. Pat. No. 2,758,416.

Most of these prior art articulated figures include complex structures and mechanisms resulting in substantial manufacturing and assembly costs. These typical prior art figures are not adapted to undergo a change in posture such as curling up and bringing the knees to the chest and the head downward to simulate the complex actions of a stunt person.

SUMMARY OF THE INVENTION

An object of the present invention is to provide a new and improved figure toy that undergoes a posture change upon impact with an object or the ground.

A further object of the present invention is to provide a new and improved device for launching or for propelling a figure toy into the air.

Briefly, the present invention is directed to a new and improved articulated figure toy that is adapted to undergo a posture change upon impact, and to provide new and improved devices for launching a figure toy into the air. The articulated figure toy includes a mid-torso portion having an upper torso portion and a hip portion pivotally connected thereto. A bistable force imparting device is secured to and extended between the upper torso and hip. The stable positions of the force imparting device correspond to an upright posture and a doubled over posture of the articulated figure toy. The articulated figure toy may be manually positioned in the upright or standing posture corresponding to one of the stable positions of the force imparting device, whereupon the figure will remain in that position. The figure may then be hurled against an object or dropped from an elevational position to the ground. Upon impact with an object or the ground surface, the resultant inertial force will move the force imparting device out of its stable position causing it to release stored energy as it moves to its other stable position thereby causing the figure toy to assume the doubled up posture.

The articulated figure also includes a pair of legs and arms. The arms and legs are pivotally secured to the corresponding body portions. These limbs are also coupled to pivot points such that the force imparting device will alter their positions upon movement of the force imparting device. A head is also secured to the top of the upper torso portion and secured to one end of the force imparting device to allow movement of the head upon movement of the force imparting device.

The present invention is also directed to new and improved devices for launching the figure against an object or into the air and to a new and improved means for actuating these launching devices. One of these launching devices includes a platform having a longitudinally extended slot or guide to which is slideably mounted a platform onto which the figure may be mounted. The slideable platform is held by a latch in a prelaunching position against a biasing force of a spring or similar device. The latch is actuated by an air bellows releasing the platform to launch the figure.

A second launching device includes a platform having a hinged portion to which the figure toy is releasably secured. The hinge portion includes a slide biased into a position holding the figure onto the hinged portion of the platform. The hinged portion is then pivoted about the platform by an expansible element in a manner such that as the portion is pivoted, the capturing slide engages the base and is moved to release the figure.

BRIEF DESCRIPTION OF THE DRAWINGS

The present invention together with the above and other objects and advantages will best appear from the following detailed description of illustrative embodiments of the invention shown in the accompanying drawings, wherein:

FIG. 14 is a perspective view of a second launching device constructed in accordance with the present invention;

FIG. 15 is a top plan view on an enlarged scale of the second launching device;

FIG. 16 is a vertical section taken generally along line 16—16 in FIG. 15;

FIG. 17 is a view similar to FIG. 16 with the pivoted portion of the second launching device in a raised position;

FIG. 18 is a perspective view of one component of the second launching device;

FIG. 19 is an enlarged, perspective view of a clip for mounting an actuator on the launching devices; and FIG. 20 is a cross-sectional view of the assembly used to actuate the launching devices.

DETAILED DESCRIPTION OF THE PREFERRED EMBODIMENT

Figures 1, 2, 3, 4, 5, 7:
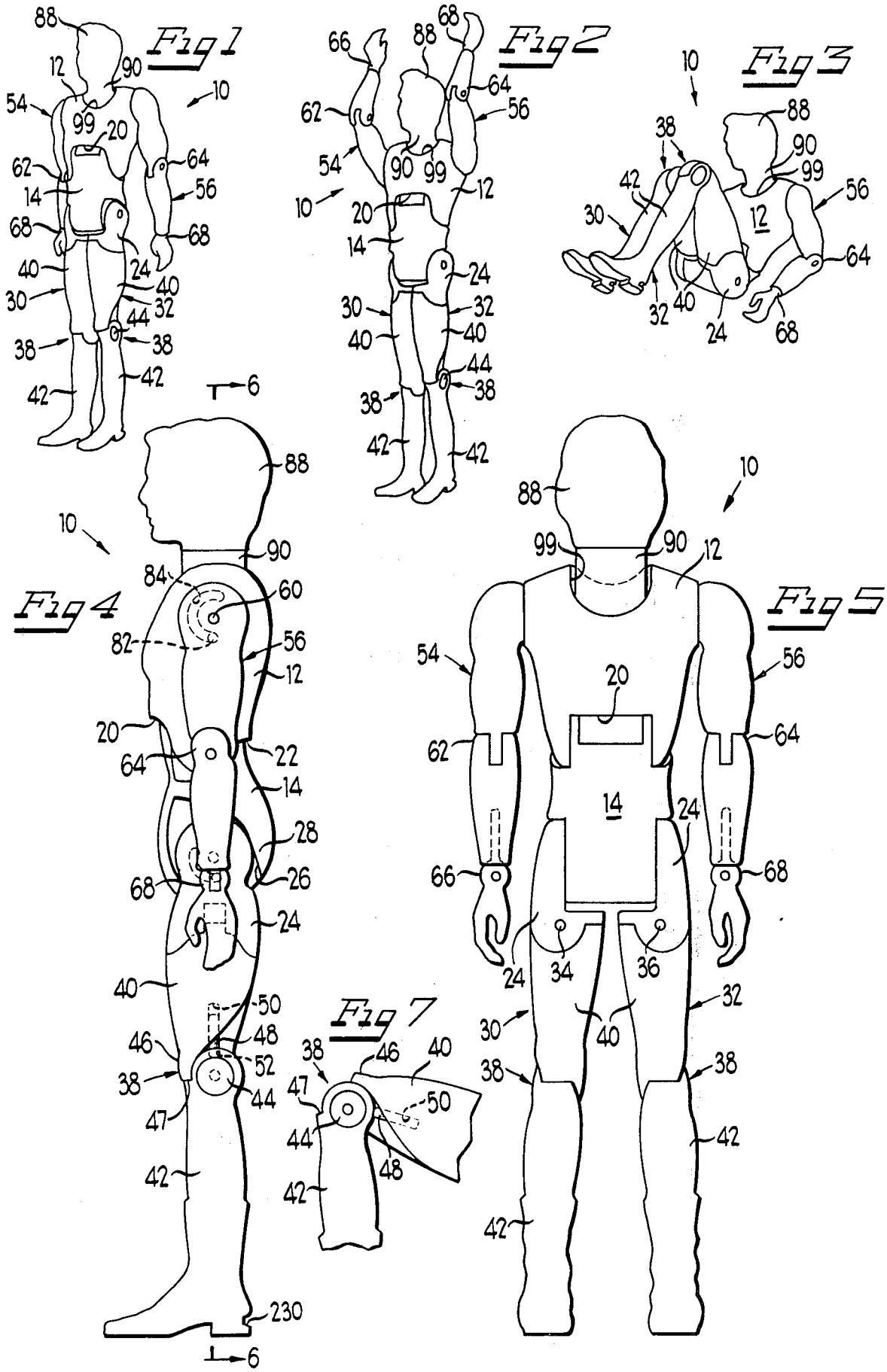
FIG. 1 is a perspective view of an articulated figure toy constructed in accordance with the present invention in a standing posture.
FIG. 2 is a perspective view of the articulated figure toy in an upright posture with the arms raised.
FIG. 3 is a perspective view of the articulated figure toy in a doubled over posture corresponding to that posture assumed after impact with an object.
FIG. 4 is an enlarged, side elevational view of the articulated figure toy.
FIG. 5 is a front elevational view of the articulated figure toy of FIG. 4.
FIG. 7 is a partially, fragmented view of a knee joint of the articulated figure toy.
Figure 8:
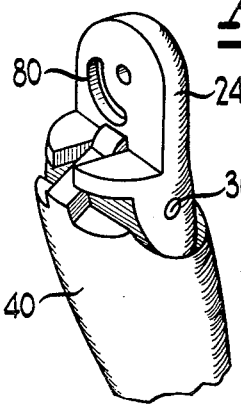
FIG. 8 is a partial, fragmentary view on an enlarged scale of the upper portion of a leg of the articulated figure toy.
Figure 9:
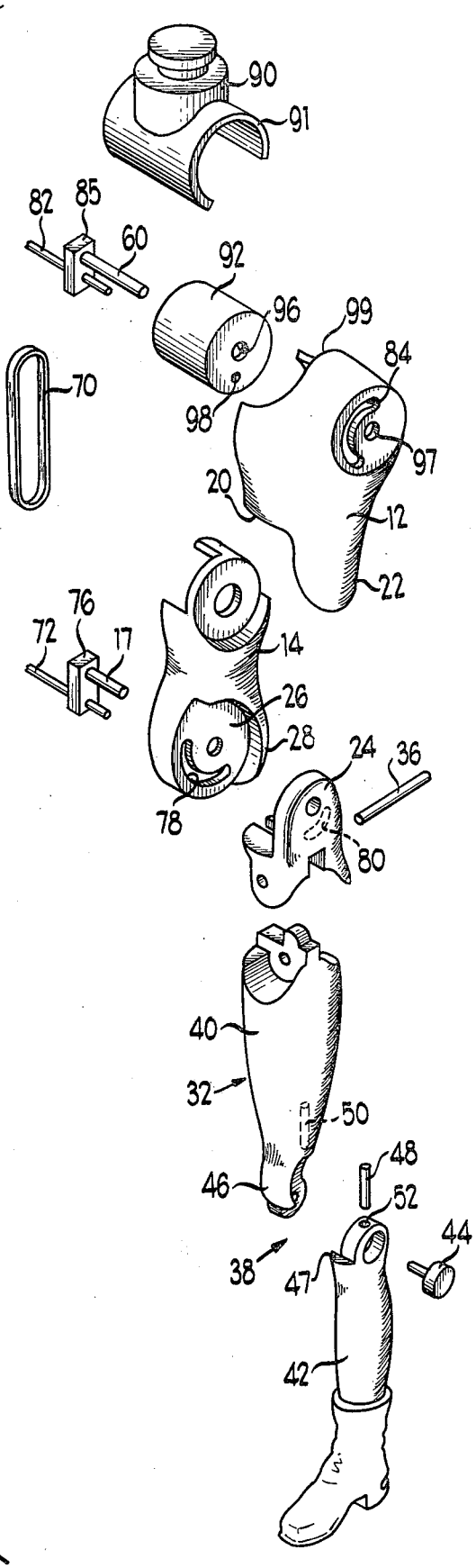
FIG. 9 is a fragmentary, exploded view of one side of the articulated figure toy.

Having reference now to the drawings, and initially to FIGS. 1–9, there is illustrated an articulated figure toy or doll generally designated by reference numeral 10 embodying the principles of the present invention. The articulated figure toy 10 is adapted to undergo a change in posture upon impact with an object in a manner similar to a stunt person.

For example, the figure toy 10 may be manually positioned in either of the postures illustrated in FIGS. 1 and 2 and upon impact with an object, the toy 10 will alter its posture to that illustrated in FIG. 3. More specifically, after impact with an object, the toy 10 will pivot at the waist, bend the head forward, and draw the knees to the chest in a manner substantially similar to the action of a stunt man. Accordingly, the preferred embodiment is illustrated as a man; however, the principles of the present invention may be employed in figures having different configurations or appearances.

Figure 6:
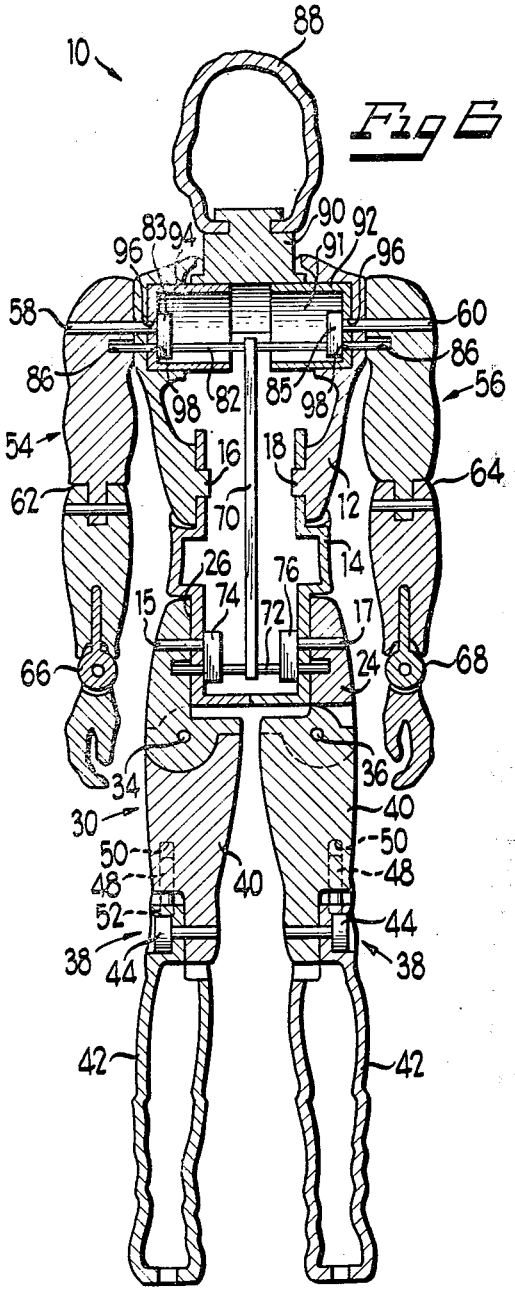
FIG. 6 is a vertical section taken generally along the lines 6—6 of FIG. 4.
Figure 10:
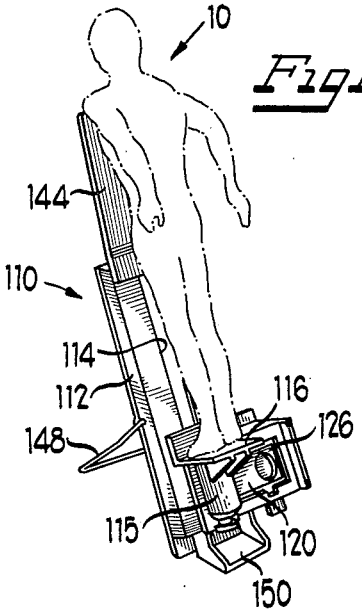
FIG. 10 is a perspective view of a first launching device constructed in accordance with the present invention.
Figure 11:
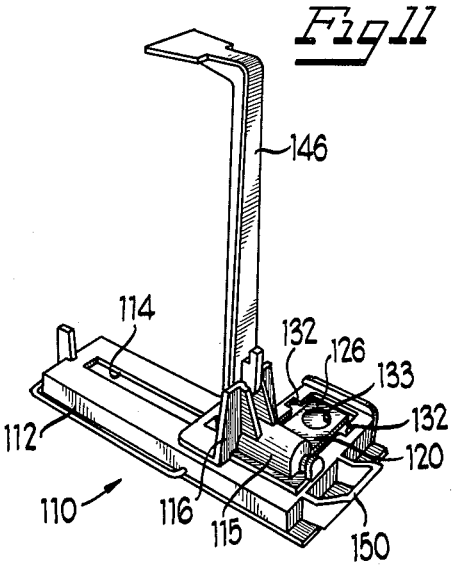
FIG. 11 is a perspective view of the launching device including an accessory.
Figure 12:
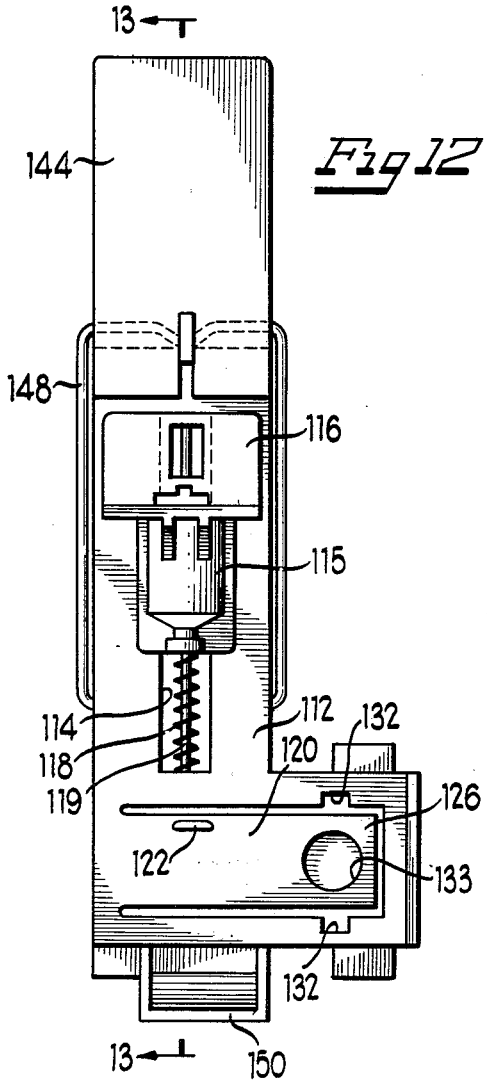
FIG. 12 is an enlarged, generally elevational view of the launching device.
Figure 13:
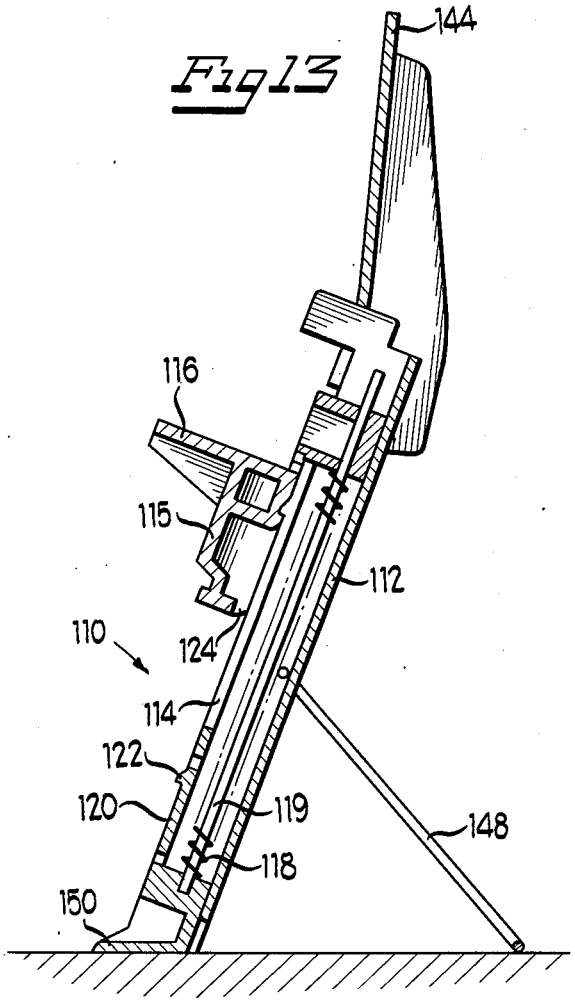
FIG. 13 is a vertical section taken generally along line 13—13 in FIG. 12.

In order to change its posture, the toy 10 includes an upper torso portion 12 and a central or mid-torso portion 14 that are pivotally coupled at pivot points 16 and 18 (FIG. 6). Since the preferred action of the figure toy 10 as illustrated is to bend forwardly upon impact with an object, the upper torso portion 12 includes a front cut out 20 and a rear extension 22 that overlaps the central torso portion 14. In this manner, the cut out 20 allows forward pivoting of the upper torso 12 relative to the central torso 14 while the extension 22 will engage the central torso 14 and resist backward motion of the upper torso 12 relative to the central torso 14.

Since it is also desired in the preferred embodiment that the legs bend toward the upper torso 12 upon impact of the figure toy with an object, the figure toy 10 includes a lower torso or hip portion 24 that is pivotally secured to the central torso 14 by pins 15 and 17 (FIG. 6). The hips 24 are mounted within large cut-outs 26 molded in the central torso 14 (FIG. 9) to provide a smooth exterior surface. In order to allow movement of the hips 24 to draw the legs of the figure toy 10 to the upper body 12, the cut-outs 26 include a stop 28 extending along the back portion thereof. In this manner, the hips 24 may pivot in a forward direction relative to said central torso 14 but are prevented by the stops 28 from pivoting in a backward direction.

The figure toy 10 further includes a pair of legs generally designated 30 and 32 secured to the hips 24 by pins 34 and 36. Since the figure toy is adapted to draw its legs 30 and 32 to the upper torso 12 upon impact with an object, each leg 30 and 32 includes an articulated joint or knee 38 that joins a thigh 40 to a lower leg 42 by a pin 44. The thigh 40 includes a stop 46 that engages a notch 47 in the lower leg 42 to prevent unnatural forward bending of the lower leg 42 relative to the thigh 40. The thigh 40 is molded, however, to allow backward bending of the lower leg 42 relative to the thigh 40.

The knees 38 are fabricated such that sufficient friction exists to prevent bending under a force due to, for example, inertia that is below a given magnitude. Accordingly, the user of the figure toy may manually straighten the legs 30 and 32 and they will remain in that position until a force above the selected magnitude is applied to bend the legs 30 and 32.

If further restraint against bending of the legs 30 and 32 is desired, a pin 48 may be inserted in a slot 50 fabricated in each thigh 40 (FIGS. 6 and 7). The pin 48 is adapted to slip into an indention 52 fabricated in the lower leg 42. Accordingly, when the legs 30 and 32 are in the straight or extended position, the pin 48 is partially positioned in the indention 52. In this configuration a greater force must be imparted to the legs 30 and 32 to pivot the pins 48 away from the indentions 52.

The figure toy 10 also includes a pair of arms generally designated 54 and 56 pivotally mounted on the upper torso 12 by pins 58 and 60 (FIG. 6). The arms 54 and 56 are articulated at elbows 62 and 64, and at wrists 66 and 68.

In accordance with an important feature of the present invention, there is included an energy storing device that, in the preferred embodiment illustrated, corresponds to a rubber band 70. The energy storing device has a stable position corresponding to any of the postures of the figure toy 10 illustrated in FIGS. 1, 2 and 3. The energy storing device 70 serves to store energy in an over-center position as shown in the positions corresponding to either of the postures illustrated in FIGS. 1 and 2 and upon impact of the figure toy 10 while positioned in either of these postures, releases the stored energy causing the figure toy 10 to alter its posture to that illustrated in FIG. 3.

In order to impart the energy released by the device 70 to the figure toy 10, one end of the device 70 is coupled to a shaft 72 mounted by a pair of crank arms 74 and 76 to the pivot pins 15 and 17 such that the shaft 72 may pivot about the pins 15 and 17 under the influence of the energy storing device 70. More specifically, the shaft 72 extends into arcuate slots 78 (FIG. 9) fabricated in the central torso 14 and into a similar groove or partial slot 80 fabricated in the hips 24. The grooves 80 are offset relative to the slots 78 when the figure toy is in a standing position. Consequently, the middle torso 14 does not restrict pivotal movement of the shaft 72 about the pins 15 and 17 which bends or pivots the hips 24 forward but will restrict the pivotal movement of the shaft 72 in a backward direction that would tend to pivot the legs 30 and 32 backward from an erect posture.

Similarly, the groove 80 is fabricated relative to the slot 78 such that during the forward pivoting of the shaft 72, the shaft 72 is against an end of the groove 80 and serves to pivot the hips 24 and legs 30 and 32 toward the upper body 12. When the shaft 72 pivots the full length of the slot 78, the motion of the shaft 72 is terminated. However, due to the offsetting of the slots 80, relative to the slots 78, the hips 24 and the legs 30 and 32 may continue to pivot the length of the groove 80 thereby allowing the legs 32 to pivot closer to the upper torso 12 to provide a more realistic action.

The energy storing device 70 is coupled to a second shaft 82 in the upper torso 12 that extends between the shoulders and through arcuate slots 84 (FIG. 9) fabricated in the sides of upper torso 12 and into apertures 86 in the arms 54 and 56. The shaft 82 is secured by cranks 83 and 85 to the pins 58 and 60 so that it may pivot about the pins 58 and 60 under the influence of the energy storing device 70 similarly to that described above.

To complete the figure toy 10 there is included a head 88 that is mounted by a neck 90. The neck 90 includes a spring clip 91 which is adapted to encircle and thereby be frictionally secured to a pair of drums 92 and 94. The drums 92 and 94 are frictionally mounted within suitable apertures in the upper body 12. Each drum includes a first aperture 96 through which the pins 58 and 60 extend to an aperture 97 in the upper torso 12 and into the arm 56 and a second aperture 98 through which the shaft 82 extends. The drums 92 and 94 are so mounted such that they will rotate relative to the upper torso 12 upon pivoting of the shaft 82. Moreover, due to the coupling of the head 88 to the drums 92 and 94, when the shaft 82 pivots the head will also pivot relative to the upper torso 12 within the limits of the neck aperture 99. The neck aperture 99 prevents the head 88 from pivoting back too far.

The figure toy 10 undergoes a posture alteration in the following manner. The figure toy 10 may be manually extended to the posture illustrated in FIG. 1 and the energy storing device 70 is stretched to the position illustrated in FIG. 6. In this position or posture the device 70 has stored energy tending to pull the shafts 72 and 82 toward one another. However, in this posture the device 70 is in a stable over-center position since the shafts 72 and 82 are generally vertically aligned with or slightly rearward of the pivot point 18 and will not alter its position unless either point of connection of the device 70 to the shafts 72 or 82 is moved forwardly of the pivot 18 or 16. This can occur upon impact of the figure toy 10 with an object. For example, if the figure toy 10 were hit in the back around the pin 82, the device 70 would move out of the stable position and the stored energy would be released pulling the pins 72 and 82 toward each other. This action causes the upper torso 12 and the hips 24 to pivot about the middle torso 14 assuming the posture illustrated in FIG. 3.

The figure toy 10 may also be manually positioned into a posture with the arms 54 and 56 extended upwardly (FIG. 2). By extending the arms 54 and 56 upwardly the shaft 82 is pivoted in the arcuate slot 84 to another generally vertically aligned stable position wherein the energy storing device 70 is extended further than that illustrated in FIG. 6 storing a greater amount of energy. Also, the drums 92 and 94 have been pivoted relative to the clip 91. Upon impact with an object in this posture, the device 70 moves out of its stable position releasing energy and causing the upper torso 12, and the hips 24 to pivot in the manner previously described. Simultaneously with this posture alteration, the arms 54 and 56 are pivoted downwardly and the inertial force serves to pivot the arms at the elbows. Also, due to the pivoting of the legs 30 and 32, inertial forces result in bending at the knees 38. In addition, the drums 92 and 94 are rotated by the shaft 82 and the pivoting of the upper torso 12 thereby rotating the head 88 forwardly and to the position illustrated in FIG. 3.

As previously described, the figure toy 10 is adapted to undergo an alteration of posture under the influence of the energy storing device 70 upon impact. One method of accomplishing this is to launch the figure toy 10 into the air or against an object. A launching device that performs this function is illustrated in FIGS. 10–13 and generally designated by the reference numeral 110. The launching device 110 includes base 112 having a longitudinal slot or guideway 114. Slideably mounted within the guideway 114 is a slide or platform 116 of a configuration including simulated rocket propulsion means 115 such that a toy such as the figure toy 10 may be positioned thereon. The platform 116 is biased in a forward direction by a spring 118 wrapped about a guide shaft 119. The figure toy 10 may be launched by moving the platform 116 against the bias of the spring 118 and then releasing the platform 116.

In order to provide the launching device 110 with the capability of launching the figure toy 10 from a remote location at a preselected time, the launching device 110 includes a cantilever latch 120. The latch 120 includes a raised portion or tab 122 that is adapted to be captured by a hook member 124 fabricated on the platform 116. Accordingly, the platform 116 may be moved against the bias of the spring 118 to a position such that the hook 124 is locked onto the raised portion 122 thus holding the platform 116 against the bias of the spring 118. The platform 116 may be released from this position by depressing the free end 126 of the latch 120 causing the raised portion 122 to move away from the hook 124.

To launch the figure toy 10 from a remote location, an actuating assembly generally designated by the reference numeral 128 (FIG. 20) may be employed. The assembly 128 includes a clip 130 (FIG. 19) that attaches the assembly 128 to the launching device 110. More specifically, the launching device 110 includes a pair of cut outs 132 adjacent an aperture 133 on the free end 126 of the latch 120. The clip 130 includes a pair of resilient legs 134 each including a hook end 136. The legs 134 are adapted to be inserted into the cut outs 132 to secure the clip 130 to the device 110 at a point adjacent to the free end 126 of the latch 120. To depress the free end 126 and release the platform 116, an expansible bellows 138 is mounted within the clip 130. Accordingly, once the clip 130 is secured to the device 110, the bellows 138 may be expanded to depress the end 126 and launch the figure toy 10.

The actuation of the bellows 138 is controlled by a second bellows 140 that is coupled in fluid communication to the first bellows 138 by a flexible conduit 142. In this manner, the operator of the device 110 may be positioned a distance from the device and may launch the figure toy 10 by compressing the bellows 140 that, in turn, causes the bellows 138 to expand.

The launching device 110 may also include a support 144 that may be clipped to the base 112 and employed to support the figure toy 10 prior to launching. In addition, the device 110 may include an L-shaped impact member 146 that may be clipped onto the platform 116. The member 146 may be employed to travel with the platform 116 once it is launched striking a figure toy 10 positioned on the base 112 causing the figure toy 10 to undergo a posture alteration in the manner previously described.

Furthermore, the launching device 110 may be adjusted to vary the angle at which the figure toy 10 is launched. The device 110 includes an adjustable support 148 and an end base portion 150. One end of the support 148 is pivotally secured to the base 112 and the other end may be positioned on the ground at different angles relative to the base 112. In this manner, the base 112 is inclined and supported on the end base 150 thereby varying the angle at which the figure toy 10 may be launched.

A second device for launching the toy such as the figure toy 10 is illustrated in FIGS. 14–18 and is generally designated by the reference numeral 210. The device 210 includes a base 212 including a platform 214 pivotally secured or hinged to the base 212. The platform 214 includes a pair of cups 216 and 218 and U-shaped members 215 and 217 into which the toes and heels, respectively, of the figure toy 10 may be positioned in order to facilitate positioning of the figure toy 10 on the platform 114.

To hold the figure toy 10 onto the platform 114 in a manner such that the figure toy 10 can be released when desired, the platform 214 includes a pair of L-shaped guide members 220 into which a slide or capturing member 222 is mounted. The slide 222 is biased by a resilient device or rubber band 224 against an abutment member 226 formed on the base 212. The slide 222 includes a knife edge portion 228 that, in the prelaunch configuration, is positioned over a portion of the U-shaped members 215 and 214 (FIG. 15). The edge 228 is intended to fit into indentions formed in the heels of the figure toy 10 such as indentions 230 (FIG. 4).

To launch a toy such as the figure toy 10, its feet are mounted within the cups 216 and 218 and the members 215 and 217 with the edge 228 engaging the indentions 230. The platform 214 is then pivoted relative to the base 212 (FIG. 17). As the platform is pivoted the over-center mechanism is actuated and the figure toy changes posture and then the end of the slide 222 engages the member 226 causing the slide 222 to move relative to the platform 214 moving the edge 228 away from the members 215 and 217 and, thus, out of the indentions 230. Once the edge 228 is moved out of the indentions 230, the figure toy 10 is released and launched.

The platform 214 may be pivoted through the employment of the bellows assembly 128. More specifically, the clip 130 may be attached to the base 212 as previously described such that upon expansion, the first bellows 138 will engage an extension 232 molded on the platform 214 causing the platform 214 to pivot relative to the base 212.

While the invention has been described with references to details of the illustrated embodiments, it should be understood that such details are not intended to limit the scope of the invention as defined in the following claims.

What is claimed and desired to be secured by Letters Patent of the United States is:

1. An articulated figure toy comprising:

a central torso portion;

an upper torso portion pivotally coupled to said central torso portion;

a lower torso portion pivotally coupled to said central torso portion; and connecting means connected between said upper and lower torso portions, said connecting means including a biasing means having a stable over-center position when the torso portions are generally aligned corresponding to a standing position of the figure toy and a released position corresponding to a bending position of the figure toy, for maintaining the figure toy in the over-center position and for movement of the figure toy torso portions to the released position upon impact to the figure toy in a manner to move said biasing means off said over-center position.

2. The figure toy of claim 1 wherein said connecting means includes a generally transverse rod rotatably mounted on said upper torso and a generally transverse rod mounted on said lower torso, said biasing means having a first end coupled to said upper torso rod and a second end coupled to said lower torso rod, said over-center position being defined by general alignment of said rods with the pivotal connection between said upper and central torso portions.

3. The figure toy of claim 2 including a head member coupled to said upper torso rod for movement relative to said upper torso by said biasing means upon said impact to the figure toy.

4. The figure toy of claim 2 further comprising a pair of limbs coupled to said upper torso rod for pivotal movement relative to said upper torso portion upon said impact to said figure toy.

5. The figure toy of claim 4 wherein said limbs each include an articulated joint adapted to allow bending thereof, said joints including means preventing bending by a force less than of a preselected magnitude.

6. The figure toy of claim 4 said connecting means further including crank means for mounting said upper torso rod and lost motion means between said limbs and said crank means to permit selective rotation of said upper torso rod to a second, stable position.

7. A figure toy for performing posture changes upon impact, comprising:

a torso having a middle portion, an upper torso portion pivotally coupled to said middle portion at a first pivot point, and a lower torso portion pivotally coupled to said middle portion at a second pivot point;

tension means secured to said upper torso portion at a point spaced from said first pivot point and secured to said lower torso portion at a point spaced from said second pivot point, said tension means including means for applying a force to said upper and lower torso portions to pivot said upper and lower torso portions about said first and second pivot points, respectively; and said middle torso portion including means to prevent said force from causing pivoting of said upper and lower torso portions in a first direction relative thereto thus maintaining said torso portions in substantial vertical alignment and to permit pivoting of said upper and lower torso portions in a second direction relative thereto.

8. The figure toy of claim 7 further comprising a plurality of limbs pivotally secured to said body, each of said limbs being coupled to said tension means and adapted to be pivoted thereby upon pivoting of said upper and lower torso portions.

9. The figure toy of claim 8 wherein at least one of said limbs includes an articulate joint adapted to allow bending of said one limb, said joint including means for resisting the bending of said joint.

10. The figure toy of claim 7 further comprising a head member coupled to said tension means and adapted to be pivoted thereby relative to said body.

* * * * *